US005575720A

United States Patent [19]

Daniel

[11] Patent Number: 5,575,720

[45] Date of Patent: Nov. 19, 1996

[54] GOLF CLUB PROTECTOR

[76] Inventor: Benjamin D. Daniel, 1 Hickley Gardens, Brockworth, Gloucester, GL3 4QS, England

[21] Appl. No.: 514,740

[22] Filed: Aug. 14, 1995

[30] Foreign Application Priority Data

Aug. 18, 1994 [GB] United Kingdom ..... 9416714

[51] Int. Cl.[6] ..... A63B 69/36

[52] U.S. Cl. ..... 473/282; 150/160; 206/315.2; 206/315.6

[58] Field of Search ..... 273/32 R, 32 E, 273/77 R, 81 D, 162 R, 162 F, 194 A, 194 B; 150/160; 206/315.2, 315.3, 315.4, 316.6; 473/282, 223, 219

[56] References Cited

U.S. PATENT DOCUMENTS

| | | | |
|---|---|---|---|
| 2,608,409 | 8/1952 | Pinkerton | 273/194 B |
| 4,991,839 | 2/1991 | Lumbattis, Jr. | 273/32 R |
| 5,050,884 | 9/1991 | Flory | 273/162 R |
| 5,076,581 | 12/1991 | Boberg | 273/32 R |
| 5,275,278 | 1/1994 | Henry et al. | 206/315.6 |
| 5,393,581 | 2/1995 | Mares | 273/162 F |

FOREIGN PATENT DOCUMENTS

| | | | |
|---|---|---|---|
| 2274400 | 7/1994 | United Kingdom | 273/194 B |

*Primary Examiner*—William M. Pierce
*Attorney, Agent, or Firm*—Young & Thompson

[57] ABSTRACT

A golf club protector comprises a split sleeve which can be placed on the shaft of a golf club to grip the latter and then inserted into the free end of a golf club storage tube.

6 Claims, 2 Drawing Sheets

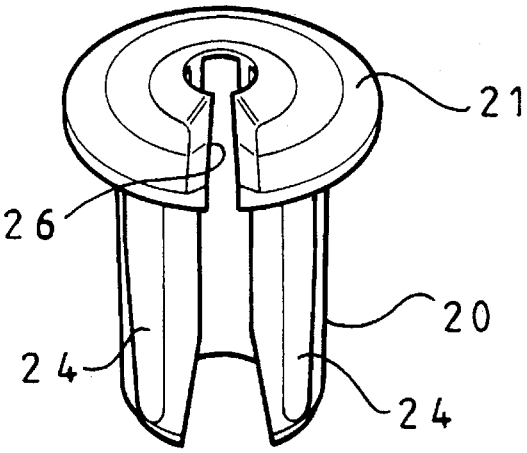
FIG 5
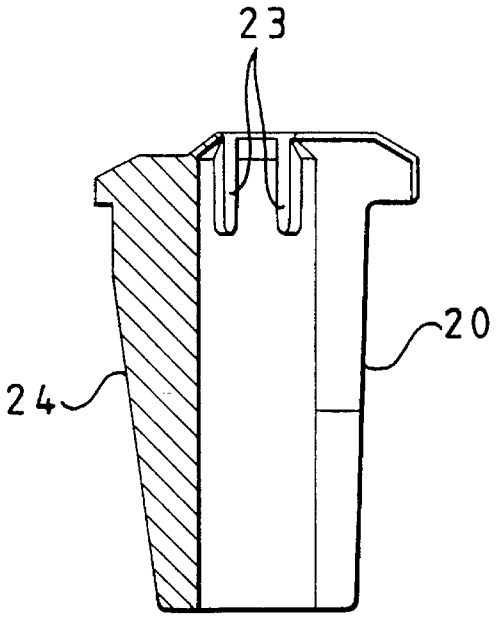
FIG 7
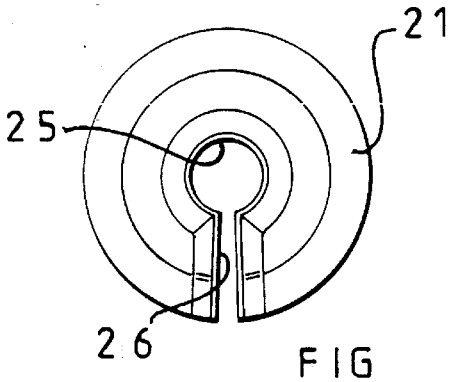
FIG 8
FIG 6
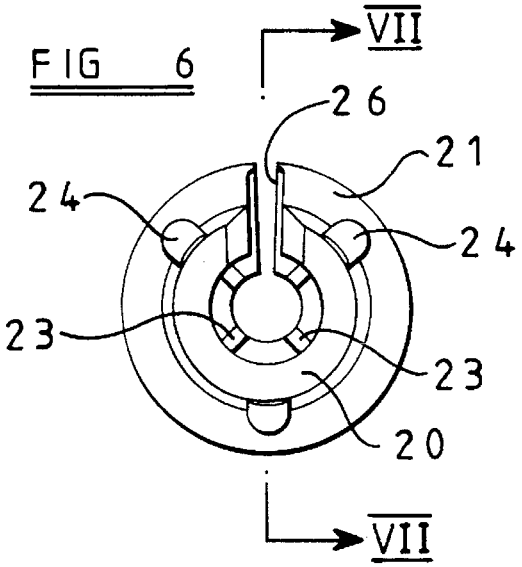

GOLF CLUB PROTECTOR

INTRODUCTION

This invention relates to a golf club protector.

Golf clubs are stored in golf bags. It has become common practice to provide golf bags with a plurality of plastics tubes for each receiving an individual golf club. These tubes prevent the clubs from becoming entangled in the golf bag with the consequential risk of damage to the clubs particularly as individual clubs are withdrawn from the bag.

It is now quite common to produce the shafts of golf clubs in materials such as carbon graphite, boron, glass fibres and combinations thereof and it has been found that the tubes produce circular score marks on the shafts of the golf clubs, particularly in a region where the free upper ends of the tubes come into contact with the golf club shafts. These score marks detract from the aesthetic appearance of the clubs and can, with time, cause damage to the clubs.

SUMMARY OF THE INVENTION

In seeking to overcome this drawback, the present invention provides a golf club protector comprising a split sleeve which can be placed on the shaft of a golf club to grip the latter and then inserted into the free upper end of a golf club storage tube.

Preferably, the sleeve is formed of resilient material such as a resilient or foam plastics material.

Preferably, the sleeve has at least a portion tapering to that end of the sleeve which is intended for insertion into a golf club storage tube.

Preferably, the split in the sleeve is defined by a slot extending the longitudinal extent of the sleeve, the slot being divergent from the inner peripheral surface to the outer peripheral surface of the sleeve and/or including at least a portion which diverges towards one end of the sleeve to facilitate the placing of the sleeve on the shaft of a golf club.

Conveniently, the sleeve has an annular indentation or protrusion on its outer peripheral surface to serve as a grip.

Alternatively, the sleeve may have a skirt portion and a head portion, the skirt portion having an internal diameter larger than the diameter of the shaft of a golf club and a plurality of internal ribs which, in use, grip the shaft of a golf club to support the latter. In this case, preferably, the skirt portion also has a plurality of external ribs which taper from their ends adjacent to the head portion so that the skirt portion can be inserted as a push fit into the end of a golf club storage tube.

The invention also provides a golf club storage tube fitted with a golf club protector as described above.

The invention also provides a golf club having a golf club protector as described above mounted on the shaft of the golf club.

The invention will now be more particularly described by way of example, with reference to the accompanying drawings.

BRIEF DESCRIPTION OF THE DRAWINGS

FIG. 5 is a perspective view of another embodiment of a golf club protector according to the invention, FIG. 6 is a bottom plan view of the golf club protector shown in FIG. 5, FIG. 7 is a section taken along line VII—VII of FIG. 6, and FIG. 8 is a top plan view of the golf club protector shown in FIG. 5.

DESCRIPTION OF THE PREFERRED EMBODIMENTS

Figure 1:
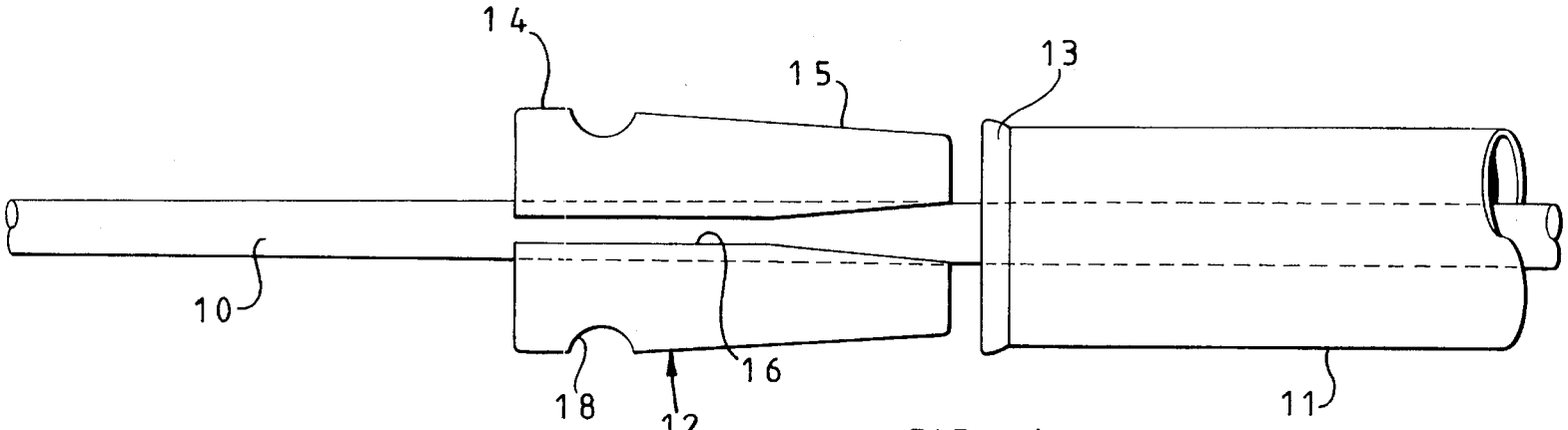
FIG. 1 is a side view showing part of the shaft of a golf club, part of a golf club storage tube and one embodiment of a golf club protector according to the present invention.
Figure 2:
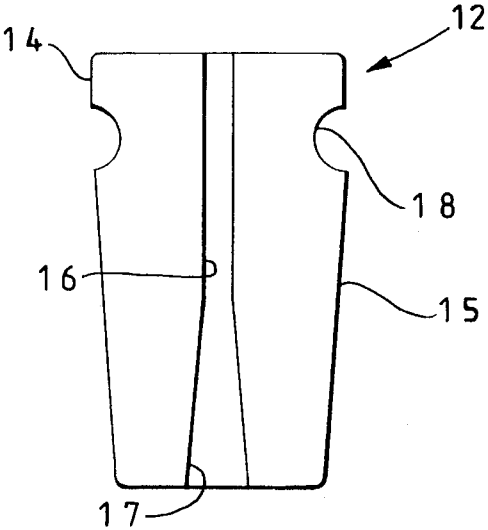
FIG. 2 is a side view of the golf club protector shown in FIG. 1.

Referring now to the drawings, FIG. 1 shows part of the shaft 10 of a golf club, part of a golf club storage tube 11 and a golf club protector 12. The tube 11 is of conventional shape and together with other like tubes, is fitted in a golf bag (not shown) to prevent the golf clubs from becoming entangled. The tube 11 is of right cylindrical shape and has a rounded end 13.

The protector 12 is in the form of a split sleeve of deformable material so that it can be placed on the shaft 10 of the golf club and then inserted into the end of the storage tube 11. In a preferred embodiment, the sleeve is formed of compressible, resilient material, typically foam plastics material.

The protector 12 has a right cylindrical portion 14 at one end and a portion 15 which tapers from the portion 14 towards its other end so that it can be inserted as a push fit into the end of the tube 11.

Figure 3:
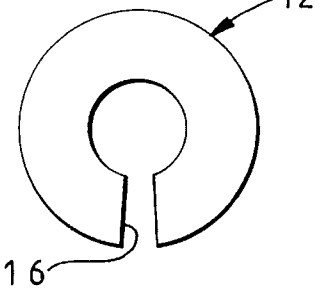
FIG. 3 is a top plan view of the golf club protector shown in FIG. 2.
Figure 4:
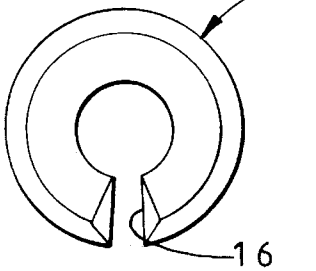
FIG. 4 is a bottom plan view of the golf club protector shown in FIG. 2.

The split in the sleeve is defined by a slot 16 extending the longitudinal extent of the sleeve. The slot 16 is divergent from the inner peripheral surface to the outer peripheral surface of the sleeve, as shown in FIGS. 3 and 4, and includes a portion 17 which diverges towards said other end of the sleeve to facilitate the placing of the sleeve on the shaft 10 of the golf club.

The sleeve has an annular indentation 18 on its outer peripheral surface to serve as a grip, although the indentation could be replaced by one or more annular protrusions, such as in the form of spaced annular ribs.

In use, when it is desired to place the golf club in a tube 11 in a golf bag, the protector 12 is placed over the shaft 10 of the golf club, the shaft passing through the slot 17 and into the central bore of the sleeve, and the protector 12 is then inserted as a push fit into the end of the tube 11.

The protector thus prevents contact between the shaft 10 of the golf club and the tube 11 and this protects the shaft 10 from being scored by the tube 11.

Also, the protector prevents water from entering the tube 11 thus keeping the grip of the club dry.

The golf club protector shown in FIGS. 5 to 8 is in the form of a split sleeve having a skirt portion 20 and a head portion 21. The skirt portion 20 has an internal diameter significantly larger than the external diameter of the shaft of a golf club, but has a plurality of internal, circumferential spaced, axially extending ribs 23 at its end adjacent to the head portion 21 which grip the shaft of a golf club to support the latter.

The skirt portion 20 also has a plurality of external, circumferentially spaced, axial extending ribs 24 which taper from their ends adjacent to the head portion 21 so that the skirt portion 20 can be inserted as a push fit into the end of a golf club storage tube 11.

The head portion 21 has an aperture 25 which receives the shaft of a golf club as a close fit and is of sufficient diameter to close the end of the golf club storage tube 11 to prevent ingress of water. The split in the head portion 21 is defined by a slot 26 which is smaller in dimension at least at its end adjacent to the aperture 22 than the diameter of the shaft 10 of a golf club but which may diverge slightly from the aperture 22 to the outer periphery of the head portion 21 to facilitate the placing of the sleeve on the shaft 10 of a golf club. The slot 26, preferably, closes when the protector is inserted as a push fit in the golf club storage tube 11 to seal the end of the tube 11.

The golf club protector shown in FIGS. 5 to 8 is made of a resilient plastics material such as Super G Evoprene which is made by Ashland Plastics (UK) Limited, of Heanor, Derbyshire, England. This allows the sleeve to open up so that the shaft of the golf club can be passed through the split in the sleeve and it also protects the shaft against damage.

The embodiments described above are given by way of example only and various modifications will be apparent to persons skilled in the art without departing from the scope of the present invention.

What I claim is:

1. A golf club protector comprising a split sleeve which is elongated and which comprises a slot extending lengthwise of the sleeve, the sleeve being adapted to surround a shaft of a golf club, the sleeve having a skirt portion in the form of a tube having an interior and an exterior and a head portion at an end of said skirt, the skirt portion having a plurality of external ribs on the exterior thereof, said ribs protruding outwardly of the skirt a greater distance at the end of the skirt at the head portion than at an end of the skirt opposite the head portion to form a taper, whereby the skirt portion can be inserted as a push-fit into an end of a golf club storage tube.

2. A golf club protector as claimed in claim 1, wherein the sleeve is formed of a resilient material.

3. A golf club protector as claimed in claim 2, wherein said material is a plastic.

4. A golf club protector as claimed in claim 3, wherein said plastic is foamed.

5. A golf club protector as claimed in claim 1, wherein the slot is narrower at the head portion end of the skirt than adjacent an end of the skirt portion opposite the head portion.

6. A golf club protector as claimed in claim 1, wherein the skirt has a plurality of ribs extending into said interior and lengthwise of the skirt.

* * * * *